United States Patent [19]

Hirschmann

[11] Patent Number: 4,784,834

[45] Date of Patent: Nov. 15, 1988

[54] PIPETTE

[75] Inventor: Adolf M. Hirschmann, Heilbronn, Fed. Rep. of Germany

[73] Assignee: Glasgeratebau Hirschmann, Eberstadt, Fed. Rep. of Germany

[21] Appl. No.: 940,883

[22] Filed: Dec. 12, 1986

[30] Foreign Application Priority Data

Dec. 12, 1985 [DE] Fed. Rep. of Germany ..... 3543950
Apr. 25, 1986 [DE] Fed. Rep. of Germany ..... 3614085

[51] Int. Cl.[4] ..... B01L 3/02

[52] U.S. Cl. ..... 422/100; 73/864.02; 73/864.13; 73/864.16

[58] Field of Search ..... 73/864.02, 864.13, 864.15, 73/864.16; 222/386, 391; 422/100; 436/180; 604/125

[56] References Cited

U.S. PATENT DOCUMENTS 2,237,213 4/1941 Brown ..... 73/864.02
2,893,391 7/1959 Vlasic ..... 604/125
2,965,255 12/1960 Gerarde ..... 73/864.02 X
3,233,785 2/1966 Burke ..... 73/864.02
3,290,946 12/1966 Pursell ..... 73/864.15
3,525,264 8/1970 Nieglos et al. ..... 73/864.14
3,646,817 3/1972 Hinchman et al. ..... 422/100 X
3,809,298 5/1974 Harris et al. ..... 604/125 X
4,261,205 4/1981 Oshikubo et al. ..... 422/100 X
4,296,071 10/1981 Weiss et al. ..... 422/100 X

FOREIGN PATENT DOCUMENTS 2825015 12/1978 Fed. Rep. of Germany .
2851532 6/1980 Fed. Rep. of Germany .
83333458 2/1984 Fed. Rep. of Germany .
2021971 12/1979 United Kingdom ..... 422/100

*Primary Examiner*—Barry S. Richman
*Assistant Examiner*—Robert J. Hill, Jr.
*Attorney, Agent, or Firm*—Fleit, Jacobson, Cohn & Price

[57] ABSTRACT

A pipette including an expansible chamber defined by an elastic bellows or a piston and a cylinder provided with a pressure equalizing vent.

12 Claims, 2 Drawing Sheets

PIPETTE

FIELD OF THE INVENTION

The invention is concerned with a pipette including an expansible chamber defined by an elastic bellows or a piston and cylinder provided with a pressure equalizing vent.

BACKGROUND OF THE INVENTION

A pipette is known from the German Patent 28 51 532 having an elastic bulb or bellows. The draw of the bulb is restricted by given stops. In the known pipette, the liquid to be suctioned is first suctioned by means of a suction stroke into an intake top which is mounted on the casing of the pipette. Subsequently, the liquid is expelled out of the pipette by a discharge stroke. The known pipette is, for that reason, not suitable for the reception of micro-capillaries which themselves suction, i.e. in which the liquid to be suctioned is absorbed by a micro-capillary due to the capillary effect of liquids, without the need for generating, by means of a suction stroke, an internal pressure that is reduced in relation to the external pressure. If, in the known pipette, the position of the bulb, and thereby the volume inside the pipette were left unchanged during the reception of the liquid into a self-absorbing micro-capillary, the suctioning process would come to an end within a short period of time, inasmuch as the volume inside the pipette would be reduced by the fluid penetrating into the micro-capillaries and, consequently, a pressure would come into existence that prevents any further penetration of the liquid into the micro-capillaries. Also, if a discharge (pressure) stroke were carried out before the beginning of the suction process by the micro-capillaries, so as to carry out a suction stroke during the suction process, the operation of the known pipette would be too complicated. In addition, the bulb would have to be locked precisely in its position so as to prevent any tearing-off of the liquid thread in the micro-capillary.

Consequently, one object of the invention is the creation of a pipette of the type mentioned at the outset, which is suitable for the reception of a liquid, which can be used with self-absorbing micro-capillaries, and which is reliable and easy to operate and to maintain.

SUMMARY OF THE INVENTION

In accordance with the invention, this object is achieved by providing a pressure-equalizing vent in the bulb. Consequently, an equalization of pressure can take place during the suction process. In that way, the occurrence of any excess pressure inside the capillaries is prevented; such pressure, if occurring, would impede the further absorption of liquid in the micro-capillary. During the reception or absorption of the liquid, the operator may confine himself to the carrying out of that step; there is no need for any other action on his part, even after the absorption of the liquid. Once the liquid has been absorbed, the liquid remains reliably in the micro-capillary, without any additional action on the part of the operator.

The liquid may be removed from the micro-capillary when: the operator closes the pressure equalization vent and carries out a discharge (compression) stroke. In that way, the liquid is forced out by the excess pressure in the capillary.

In accordance with a further development of the invention, the pipette has a receiving member that holds a micro-capillary and includes a friction closure making it possible rapidly and simply to exchange the micro-capillary. The receiving member may be a rubber nozzle that affords safe and tight support. When the receiving member consists of two supporting surface elements arranged at a distance from one another, a particularly reliable restraint of the capillary is ensured. Inasmuch as part of the outer jacket of the pipette is an adapter for the micro-capillary, it is possible rapidly and simply to adapt the pipette of the invention to micro-capillaries of various dimensions, particularly of various diameters, by means of changing the adapter.

When the capillaries are transparent, it is possible to observe the amount of liquid charge in the capillary. By means of suitable dimensioning of the capillary, it is possible simply and precisely to measure predetermined amounts of the fluid to be aspirated. Due to the fact that the outer jacket and/or the adapter are transparent, within the area of the capillary, it is possible to measure and/or to observe the liquid to be aspirated over a relatively large stretch and if need be, over the entire length of the capillary.

When the expansible chamber is connected with a pressure pin projecting beyond the outer jacket of the pipette, it may be actuated simply by the operator. When the pressure equalization vent lies on the pressure surface of the pressure pin, it is possible to close the pressure equalization vent by simply applying a finger, particularly the operator's finger that actuates the pressure pin which is hollow and connected with the expansible chamber in an air-tight manner.

In accordance with an advantageous development of the invention, the expansible chamber is biased by a spring action in the direction of its maximum volume position and the pipette is moved back automatically to its original position after the liquid has been expelled. This effect may be reinforced by a compression spring.

When bactericides or toxic reagents are to be treated with the aid of a pipette, the operator can not touch or be touched by such substances. In many cases, however, it will be necessary to use receptacles for liquid, in particular, micro-capillaries, that have to be placed intothe pipette manually. For this reason, it is a further object of the invention to create a pipette that may be handled simply and reliably, and in which the liquid receptacle, especially a micro-capillary, may be removed and/or separated from the pipette without using the hands. This object is achieved in the case of a pipette with a liquid receptacle as follows: the receptacle is maintained in a receiving member by means of a sealing friction closure. A piston may be slid lengthwise in a cylinder, and the piston can be moved beyond the end of the compression stroke, so as to move the receptacle out of the receiving member. Because the liquid receiving member is held in a receptacle by means of a friction-closure, it may be removed from the receptacle by pressure in a longitudinal direction. A piston is guided in a cylinder in such a way that it may be slid lengthwise and may be moved beyond the end of the compression stroke, so as to remove the liquid receiving member from the receptacle and to separate it from the pipette without touching it manually. The member receiving the liquid is held tightly in a receptacle, and therefore the additional pressure required to expel the liquid that is in the liquid receiving member can be formed.

In accordance with a further advantageous development of the invention, the receptacle is a rubber nozzle which ensures that the liquid receiving member is held in a particularly simple manner, by means of a friction closure, and which seals the liquid receiving member from the piston. When the receptacle consists of two supporting surface elements arranged at a distance from one another forming a two-point support, the liquid receiving member is held especially tightly and firmly, by means of this two-point support. It is possible to adapt the liquid receiving member to members of various external dimension by an adapter for the receptacle of the liquid receiving member.

The connection of the piston with a pressure pin projecting from the external jacket of the pipette makes it possible to actuate the pipette in a simple way.

Due to a restraint of the piston stroke by stops, there exists a simple, reproducible way of measuring the liquid. When the piston is braced by means of a compression spring on the external jacket, the suction lift of the piston is effected by spring tension which facilitates operation.

In accordance with a further, particularly advantageous development of the invention, a compression spring is provided. The compression spring is braced, one the one hand, by the piston and, on the other hand, by a stop ring which, during the compression stroke, lies against a stop on the piston, and which subsequently lies against a stop of the external jacket. Due to the fact that it is necessary, after the end of the compression stroke, to overcome the force of the compression spring, in a pressure-point-like way, the discharge phase of the member receiving the liquid and the end of the compression stroke are indicated to the operator in a clearly perceptible manner. That advantage may be increased by prestressing the compression spring and/or by making it harder than the compression spring that triggers the automatic actuation of the suction stroke.

In accordance with a further advantageous development of the invention, a cylinder part is provided and lies against a section of the external jacket and has stops for the compression spring and for the stop ring. The cylinder part may be inserted into the outer jacket of the pipette, thereby facilitating the assembly.

When the pressure pin connected with the piston has a stop for the compression spring and stop surfaces for restraining the piston stroke, the stop and stop surfaces may be created in a simple manner by mounting a pressure pin on the piston to facilitate assembly. A terminal cap, supported by the outer jacket, has a stop for limiting the piston stroke and also facilitating the assembly.

In accordance with a further advantageous development of the invention, the liquid receiving member is a micro-capillary, and a pressure equalization vent is provided in the cylinder. The pipette is thereby able to make use of self-suctioning micro-capillaries.

The advantages resulting from the micro-capillary being transparent, the micro-capillary having limited dimensions, and the external jacket being transparent within the area of the micro-capillaries have already been explained.

When the pressure-equalizataion vent is at a point within the operational space where it is closed immediately following the beginning of the compression stroke, it is possible, when a micro-capillary is used, to utilize the compression stroke over its greatest possible length. This is possible also when the cylinder part as described above is used.

BRIEF DESCRIPTION OF THE FIGURES OF THE DRAWINGS

Examples of embodiments of the invention are described in the following on the basis of the drawings in which.

DETAILED DESCRIPTION OF THE PREFERRED EMBODIMENTS

Figure 1:
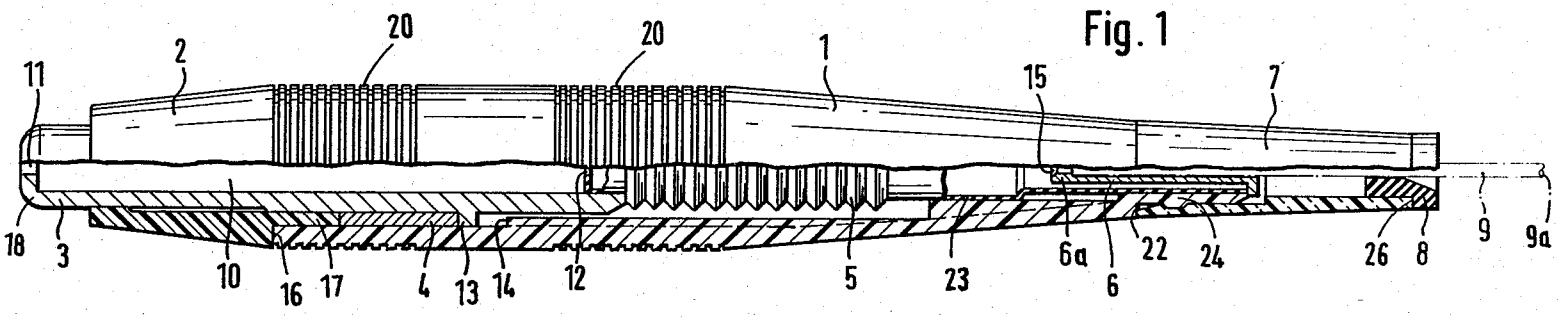
FIG. 1 is a side elevation, partly in section, showing a first embodiment of the invention.

The embodiment illustrated in FIG. 1 shows a completely plastic external body 1, 2, 7, adapted and profiled to suit the form of a person's hand. The body fits the grip of a person's hand exactly in accordance with ergonomic points of view, and includes ribs or grooves 20 in jacket 1. The outer jacket 1 is solidly connected by a detachable press fit with an adapter 17. The end of the jacket 1 is reduced in outer diameter to define shoulder 22. Adapter 7 slides over jacket 1 and abuts shoulder 22. A mutually defined detent 24 effects a snap fit. The adapter 7 is transparent and makes it possible to observe the charging and discharging process. A rubber nozzle 8 in which the micro-capillary 9 is guided is supported by adapter 7. The inner end of nozzle 8 is reduced in outer diameter to define shoulder 26. The nozzle is slid into the adapter 7 until shoulder 26 abuts the end of adapter 7 in a detachable press fit. In addition, the micro-capillary 9 is supported by bushing 6 mounted in an axial channel formed in body jacket 1. Reliable fixation of the capillary 9 is ensured by two opposed support surfaces defined by the bushing 6 and by the rubber nozzle 8. The micro-capillary 9 is transparent and provided with markings so that the charging process may be observed and the liquid to be charged can be measured exactly. A bellows 5 is connected with the edge of the bushing 6 in an air-tight manner. In addition, the bellows 5 is welded to the inner surface of the external jacket 1 as indicated at 23.

A pressure pin 3 is received in and projects beyond the external jacket 1 of the pipette. The pressure pin 3 has a cavity 10 that is connected with the outside air by way of bore hole 11 defined in the protruding end 18 of pin 3. The pressure pin 3 is connected with the bellows 5 solidly and in an air-tight manner. The internal volume of the bellows 5 is connected with the cavity 10 of the pressure pin 3 by way of opening 12 in the end wall of the bellows. A terminal cap 2 inside which the pressure pin 3 is guided is connected in a detachable press fit manner with the external jacket 1. Cap 2 has a skirt 17 of reduced outer diameter that fits within the jacket 1 and engages its inner surface. The reduced diameter defines shoulder 16 which abuts with the end of jacket 1. Inside the external jacket 1, a spacer ring 4 coaxially aligns with and abuts the terminal cap 2.

The pressure pin 3 has a section 13 of enlarged diameter that functions as a stop and coacts with two stop surfaces. In the position as shown in FIG. 1, one of the stop surfaces is defined by the end 4a of spacing ring 4. Stop ring 13 interacts with the stop surface 4a of the spacing ring 4 to limit the expanded condition of bellows 5. The other stop surface with which the stop ring 13 interacts, after the compression stroke has been executed, is the stop 14, formed by a shoulder defined by the external jacket 1. The draw or stroke of the bellows is restrained by those two stops 4a and 14.

The bellows 5 is of an elastic material and is prestressed or biased in the state as shown in FIG. 1, and, for that reason, presses the stop ring 13 against the stop 4a defined by the spacer ring 4. The elastic force of the bellows 5 may be reinforced by means of a compression spring (not shown) inside the bellows 5.

The pipette consists exclusively of individual parts that are inserted into one another. Because of this, the pipette may be assembled simply, and may be disassembled easily, without any tools, when the pipette is to be cleaned. The length of the compression stroke may be adjusted by using spacer rings 4 of varying lengths.

When operating the pipette as shown in FIG. 1, first, one slides the micro-capillary 9, through the opening of very small cross-section of the rubber nozzle 8, into the bushing 6 until it reaches the stop 6a which is defined by the innermost end of the bushing 6 or the end of the bellows 5. A bore 15 is defined in the innermost end of bushing 6 to communicate with the interior of bellows 5. When inserted, the capillary 9 is ventilated by the bore 15 of the bushing 6, by the opening 12 of the bellows 5, and by the bore 11 of the pressure pin 3, so that no internal pressure, which may impede the capillary effect, builds up in the pipette.

Depending on the geometry of the capillary 9, the entire assembled pipette 1, 2, 7, 9 is brought to the liquid to be aspirated, in a certain angled, sloping or tilted position. The charging process by capillary action begins with the dipping of the capillary tip 9a into the liquid. After the charged capillary has been taken out of the liquid, liquid remnants may be wiped off on the outer contour of the capillary and/or on the tip of the capillary. If need be, the level of the liquid in the capillary 9 may be adjusted by careful wiping, so as to meet an imprinted marking on the capillary 9. To eject the liquid, the bore 11 on the end of the pressure pin 3 is closed and, subsequently, the pressure pin 3 is pressed steadily, until the second stop surface of the stop ring 13 of the pressure pin 3 lies against the stop 14 inside the outer jacket 1. In the completely forced down state, the capillary 9 is removed from the pipette.

After release of the pressure pin 3, the pipette returns automatically to its original condition, due to the elastic force of bellows 5, which may be reinforced by a spring, The application of the finger of the operator to the end of the pressure pin 3 closes the bore 11 of the pressure pin 3 and moves the bellows 5 in the direction of the compression stroke, by one and the same motion. Due to the closing of the bore 11, it is impossible for any air to escape from the inside of the pipette during the compression stroke, so that the additional pressure necessary to force out the liquid contained in the capillary is generated by one single motion.

Figure 2:
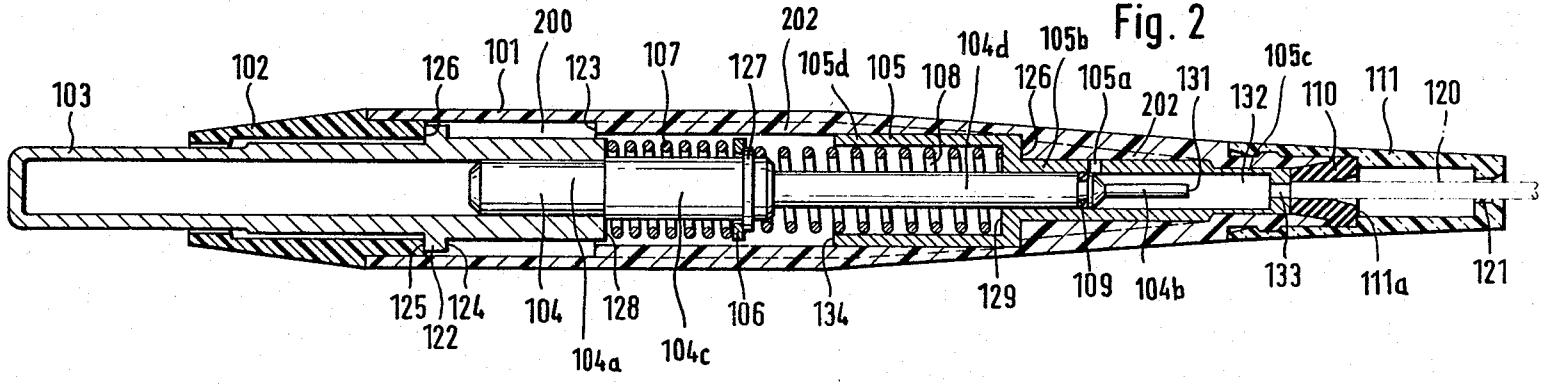
FIG. 2 is a view in section showing a second embodiment in the condition before the beginning of the compression stroke.
Figure 3:
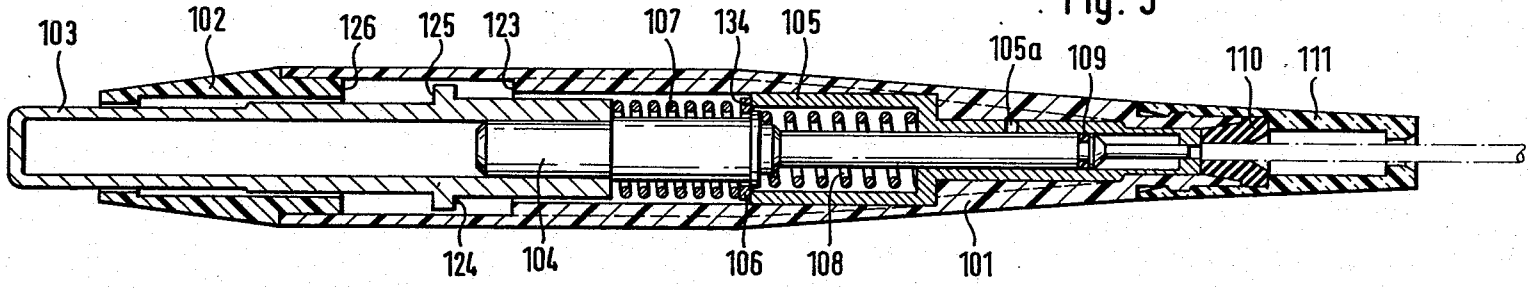
FIG. 3 is a view in section of the embodiment shown in FIG. 2 at the end of the compression stroke.
Figure 4:
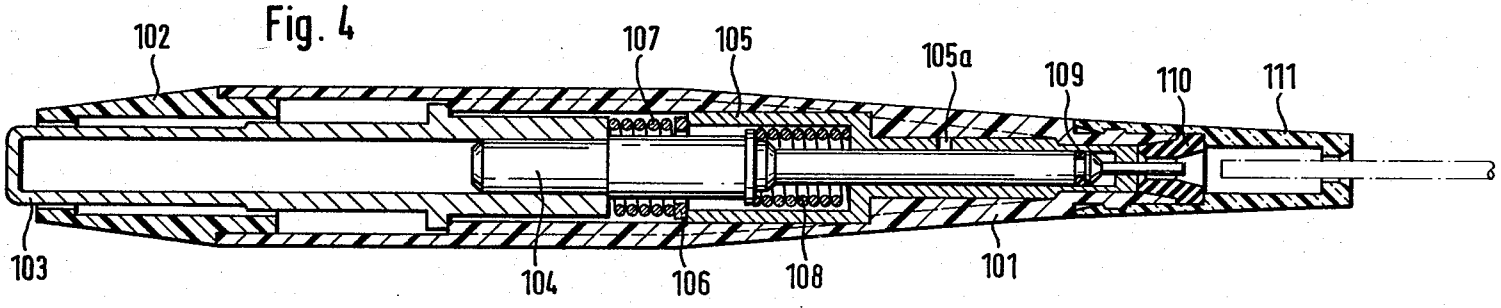
FIG. 4 is a view in section of the embodiment shown in FIGS. 2 and 3 after the movement that removes the liquid receiving member from the receptacle.

In FIGS. 2 to 4, a second embodiment of the invention is shown. The outer body of the pipette consists of an external jacket 101 on the rear end of which a terminal cap 102 is mounted, and on the front end of which an adapter 111 is mounted in the same way as described with reference to FIG. 1. A micro-capillary 120 is held in a rubber nozzle 110. Rubber nozzle 110 is engaged with the external jacket 101, tightly to effect a friction closure by means of mutually tapered surfaces. Adapter 111 defines an inner shoulder 111a to hold nozzle 110 in place. The micro-capillary 120 projects loosely through an opening 121 of the adapter 111. The rubber nozzle 110 is inserted into the exterior jacket 101 and has, at its rear end, an area of a larger diameter that is limited by two stop surfaces. One of the stop surfaces is defined by an outwardly tapered inner surface at the end of the external jacket 1, and the second stop surface is formed by the shoulder 111a defined by the adapter 111. The rubber nozzle 110 is held fixed by those two stop surfaces, when the adapter 111 is connected with the outer jacket 101 by the snap fit detent.

In the exterior jacket 101, there is mounted a cylinder part 105, a section of which engages the inside surface of the exterior jacket in contact with ribs 202 defined by the inner surface of the jacket 101. The exterior jacket 101 also has a stop 123 defined by a shoulder on its interior surface.

Cylinder part 105 is stepped twice to define section 105d of largest diameter, section 105b of middle diameter, and section 105c of smallest diameter. Inside the cylinder part 105, a piston 104 is guided, in such a way that it may be slid lengthwise. Piston 104 is also stepped to define at one end a section 104a of intermediate diameter, at the other end a section 104b of smallest diameter, and in the middle two sections 104c and 104d, section 104c being larger intermediate diameter and section 104d being of smaller intermediate diameter. In a groove of the piston 104 in section 104d, a sealing ring 109 is provided for sealing off the piston, in its relation to the section 105b of cylinder part 105. On section 104c of the piston 104, a collar 127 is defined which is larger than the diameter of section 104c of the piston 104. A compression spring 108 is supported on and bears against collar 127. The other end of the compression spring 108 is supported by a stop 129 defined on the interior surface of the cylinder part 105 by the step between sections 105d and 105b. The compression spring 108 brings about the automatic execution of the suction stroke of the pipette.

A pressure pin 103 passes through a bore in the terminal cap 102, and its outer surface defines a stop ring 122 with two stop surfaces 124, 125. The inner end of pressure pin 103 bears against the shoulder defined between the stepped sections 104a and 104c of portion 104. In the position as shown in FIG. 2, the stop surface 125 of the pressure pin 103 lies against a stop surface 126 formed by the front end of the terminal cap 102. The stop 125, 126 is reached by the pipette automatically, due to the action of the compression spring 108. The stop formed by the stop surfaces 125, 126, restricts, therefore, the suction stroke of the pipette.

A pressure spring 107 bears at one end against the inner or front end of pressure pin 103 and at its other end against a stop ring 106 which is slidably received on and movable along section 104c of piston 104. As shown in FIG. 2, the pressure spring 107 is in a prestressed condition. The front end or surface of the pressure pin 103 constitutes the stop surface 128 against which the pressure spring 107 lies. The other end of the pressure spring 107 lies against the stop ring 106 which is guided on the piston, in such a way that it may be slid lengthwise; spring 107 normally urges the stop ring 106 against the collar 127, the diameter of which is larger than section 104c of the piston 104.

A vent hole 105*a* establishes the connection with the outside air via the annular chamber 200. Annular chamber 200 is defined by the outer jacket 101 surrounding the vent hole 105*a* and through passages (not shown) which may include leakage through the non-air tight joints of the pipette. The vent hole 105*a* located in the section 105*b* of the cylinder part 105. The vent hole 105*a* communicates with the ambient atmosphere and is situated within the range of the expansible chamber or operating volume 132 of the cylinder directly beside and axially in front of the sealing ring 109 mounted on the piston section 104*d* which defines the operating volume 132. Section 104*b*, the smallest diameter section of the piston 104 terminates in a stop surface 131 and extends or projects into the operating volume 132. The diameter of the section 104*b* of the piston 104 is chosen, in such a way that it is able to pass through bore 133 defined in the front end of section 105*c* of the cylinder 105. The micro-capillary 120 lies against the outer front surface of section 105*c* of the cylinder part 105 in axial alignment with bore 133. In addition, the rubber nozzle 110, in the form of a ring, also lies against the outer front surface of section 105*c* of the cylinder part 105 and holds the end of the micro-capillary.

After the pipette has been used and a new capillary is to be loaded, the new capillary 120 is shifted manually through the opening of the adapter 111, and farther on into and through the rubber nozzle 110 to the stop on the front side or face of section 105*c* of the cylinder 105. With this two-point support, the capillary 120 is held tightly and firmly. In the state of rest as shown in FIG. 2, the piston 104 is pressed by the force of the pressure spring 107 all the way to the rear of its stroke. The stop surface 125 of the stop ring 122 engages the stop surface 126 constituted by the front or inner end surface of the terminal cap 102. At the same time, the piston 104 is unblocking the air vent 105*a* which communicates with the ambient atmosphere, so that the capillary 120 may be guided with the pipette to a liquid. When immersed, the capillary 120 is filled by capillary action. Pressure equalization takes place by way of the air vent 105*a*. When the adapter 111 is transparent, it is easy to observe at which state of charging the suction process has to be terminated. It may be helpful, in that respect, to apply markings to the transparent capillary 120.

After the completion of the suction process, it is possible to transfer the suctioned liquid to another receptacle, by pressing the piston 104 down by the pressure pin 103, against the force of the pressure spring 107. The sealing ring 109 on the front end of section 104*d* of the piston 104 moves over the air vent 105*a*, causing the build-up of a slight additional pressure, as the piston 104 moves into the working space 132; the additional pressure eventually leads to the discharge of the liquid from capillary 120.

The volume of the working space and the volume of the suctioned liquid have certain proportions relative to one another, in order that the liquid column in the capillary 120 will be "blown out" completely without any rebound of air into the capillary 120. At the end of the first part ofthe travel of piston 104, the stop ring 106 reaches the stop 134 formed by the rear surface of the cylinder 105. This condition is shown in FIG. 3. The front end 131 of the section 104*b*, which has the smallest diameter of all the sections of the piston 104, is now close to the rear end of the capillary 120. The diameter of section 104*b* is small enough to pass through the bore 133 at the front end of the cylinder part 105.

When the pressure pin 103 is depressed further, urging the piston 104 forward, the relatively high initial stressing force of the pressure spring 107 has to be overcome, like a pressure point. At this point, the discharge phase of the capillary 120 starts. The movable stop ring 106 is now restrained by stop 134 and slides relative to piston 104 as it continues to move forward through ring 106. Ring 106 moves almost up to the block length of the pressure spring 107 against the front side of the pressure pin 103. The stroke is completed when the stop surface 124 of the stop ring 122 of the pressure pin 103 hits the stop surface 123 inside the outer jacket 101; this condition is shown in FIG. 4. In this state, the piston 104 rests with the front end 131 of section 104*b* of the piston, some 2 mm in front of the narrow point of the bore of the rubber nozzle 110 which receives and supports the capillary 120. The capillary 120 has been contacted by front end 131, dislodged from nozzle 110, slid forward and released from its support by nozzle 110 totally. When the pipette is now held vertically, the capillary 120 drops out automatically.

The embodiment of the invention as shown in FIGS. 2 and 4 presents a pipette that holds the capillary tightly and axially, so that it charges itself upon contact with a liquid. When the pressure pin 103 is pressed down, the suctioned liquid is discharged evenly, slowly, and without any break of the liquid thread. When the pressure pin is depressed further, the capillary will be expelled from the pipette, without any use of the hands.

Although the invention has been shown and described with reference to specific preferred embodiments, changes and modification will be evident to one skilled in the art which do not depart from the spirit and scope of the inventive concepts taught herein. Such are deemed to fall within the purview of the appended claims.

What is claimed is:

1. A pipette comprising:

a hollow outer jacket, said outer jacket including first and second axial ends;

holding means provided adjacent said first axial end, said holding means including an adapter connected to said hollow outer jacket, said adapter including a first opening therein, and a sealing rubber nozzle fixed between said adapter and said hollow outer jacket, said sealing rubber nozzle including a second opening therein aligned with said first opening, said holding means being capable of releasably retaining a liquid receiving member within said first and second openings;

a pressure pin slidably received and retained within said hollow outer jacket adjacent said second axial end;

first stop means provided at one end of said pressure pin;

a stepped cylinder mounted within said outer jacket, said stepped cylinder including a third opening, said third opening being coaxially aligned with said first and second openings;

second stop means on said stepped cylinder;

piston means slidably received in said stepped cylinder, said piston means movable with said pressure pin;

third stop means movable along said piston means and fourth stop means provided on said piston means, wherein said third and fourth stop means are located between said first and second stop means;

said piston means and said stepped cylinder defining an operating volume adjacent said first axial end such that said operating volume is in fluid communication with said first, second and third openings;

a protruding section of said piston means extending into said operating volume and dimensioned to pass through said second and third openings;

a pressure spring disposed between said first and said third stop means, said pressure spring exerting a first spring force between said first and third stop means to normally urge said third stop means against said fourth stop means;

a compression spring disposed between said second and said fourth stop means, said compression spring exerting a second spring force on said fourth stop means to urge said piston means out of said stepped cylinder, said second spring force being less than said first spring force;

means defining a pressure-equalization vent which normally communicates the operating volume with ambient atmosphere;

wherein during a first portion of a compression stroke, said piston means is movable by said pressure pin into said stepped cylinder against said second spring force only to prevent fluid communication between the operating volume and ambient atmosphere through the pressure-equalization vent and eject liquid from a liquid receiving member retained within said first and second openings, said compression spring being compressed between said second and fourth stop means, and said third stop means being brought into contact with said stepped cylinder during such a first portion of such a compression stroke;

and wherein during a second portion of a compression stroke, said piston means is movable by said pressure pin further into said stepped cylinder against said first and said second spring forces, said pressure spring being compressed between said first and third stop means and said protruding section of said piston means passing through said third opening to contact and displace a liquid receiving member retained within said first and second openings from said second opening during such a second portion of such a compression stroke so that such a liquid receiving member is removed from said holding means.

2. The pipette in accordance with claim 1 wherein said pressure pin defines a stop that coacts with stop surfaces defined on the outer jacket for limiting the stroke of the piston means.

3. The pipette in accordance with claim 2 wherein the first stop means provided at one end of said pressure pin defines a bearing surface for the pressure spring.

4. The pipette in accordance with claim 2 wherein the outer jacket includes a terminal cap that defines one of the stop surfaces for limiting the stroke of the piston means.

5. The pipette in accordance with claim 1 further including a liquid receiving member which is releasably retained within said first and second openings by said holding means.

6. The pipette in accordance with claim 5 wherein said adapter forms a guide for said liquid receiving member, and wherein said sealing rubber nozzle supports and retains said liquid receiving member within said first and second openings.

7. The pipette in accordance with claim 5 wherein the liquid receiving member is a micro-capillary.

8. The pipette in accordance with claim 7 wherein the stepped cylinder defines in part the pressure-equalization vent.

9. The pipette in accordance with claim 7 wherein the pressure-equalization vent is positioned such that immediately after starting a compression stroke, fluid communication between the operating volume and ambient atmosphere through the pressure-equalization vent is prevented by said piston means.

10. The pipette in accordance with claim 7 wherein the micro-capillary is transparent.

11. The pipette in accordance with claim 10 wherein the micro-capillary includes volume markings thereon.

12. The pipette in accordance with claim 10 wherein the outer jacket and/or the adapter is sufficiently transparent so that it is possible to observe charging and discharging of the micro-capillary.

* * * * *